United States Patent [19]

Hegemann et al.

[11] 4,218,241

[45] Aug. 19, 1980

[54] METHOD OF RECOVERING ENERGY FROM CONVERTER EXHAUST GASES

[75] Inventors: Karl-Rudolf Hegemann, Essen-Bergerhausen; Helmut Weissert, Bochum-Hiltrop, both of Fed. Rep. of Germany

[73] Assignee: Gottfried Bischoff Bau kompl. Gasreinigungs- und Wasserrückkühlanlagen GmbH & Co. Kommanditgesellschaft, Essen, Fed. Rep. of Germany

[21] Appl. No.: 929,954

[22] Filed: Aug. 1, 1978

[30] Foreign Application Priority Data

Aug. 3, 1977 [DE] Fed. Rep. of Germany ..... 2734961

[51] Int. Cl.[2] ..... C21C 5/38; C21B 3/04

[52] U.S. Cl. ..... 75/60

[58] Field of Search ..... 75/25, 52, 60

[56] References Cited

U.S. PATENT DOCUMENTS

| | | | |
|---|---|---|---|
| 3,580,718 | 5/1971 | Rasworschegg | 75/60 |
| 3,592,630 | 7/1971 | Willett | 75/60 |
| 3,615,355 | 10/1971 | Skinner | 75/60 |
| 3,617,043 | 11/1971 | Hirao | 75/60 |
| 3,649,246 | 3/1972 | Fulton | 75/60 |
| 3,854,932 | 12/1974 | Bishop | 75/49 |
| 3,988,421 | 10/1976 | Rinaldi | 75/60 |

*Primary Examiner*—P. D. Rosenberg

*Attorney, Agent, or Firm*—Karl F. Ross

[57] ABSTRACT

Converter exhaust gases in a steel-refining plant are used for the recovery of energy, e.g. for the production of electrical energy. The steel-refining process is carried out in a closed converter maintained at a pressure of from 1 to several atmospheres gauge above ambient pressure. The converter exhaust gases at such elevated pressure is subjected to washing, preferably in the exhaust-gas stack or duct and the washed converter exhaust gases from several refining processes is stored and supplied to a gas consumer, e.g. an electrical generating plant, at a rate which is independent of the blowing period.

8 Claims, 1 Drawing Figure

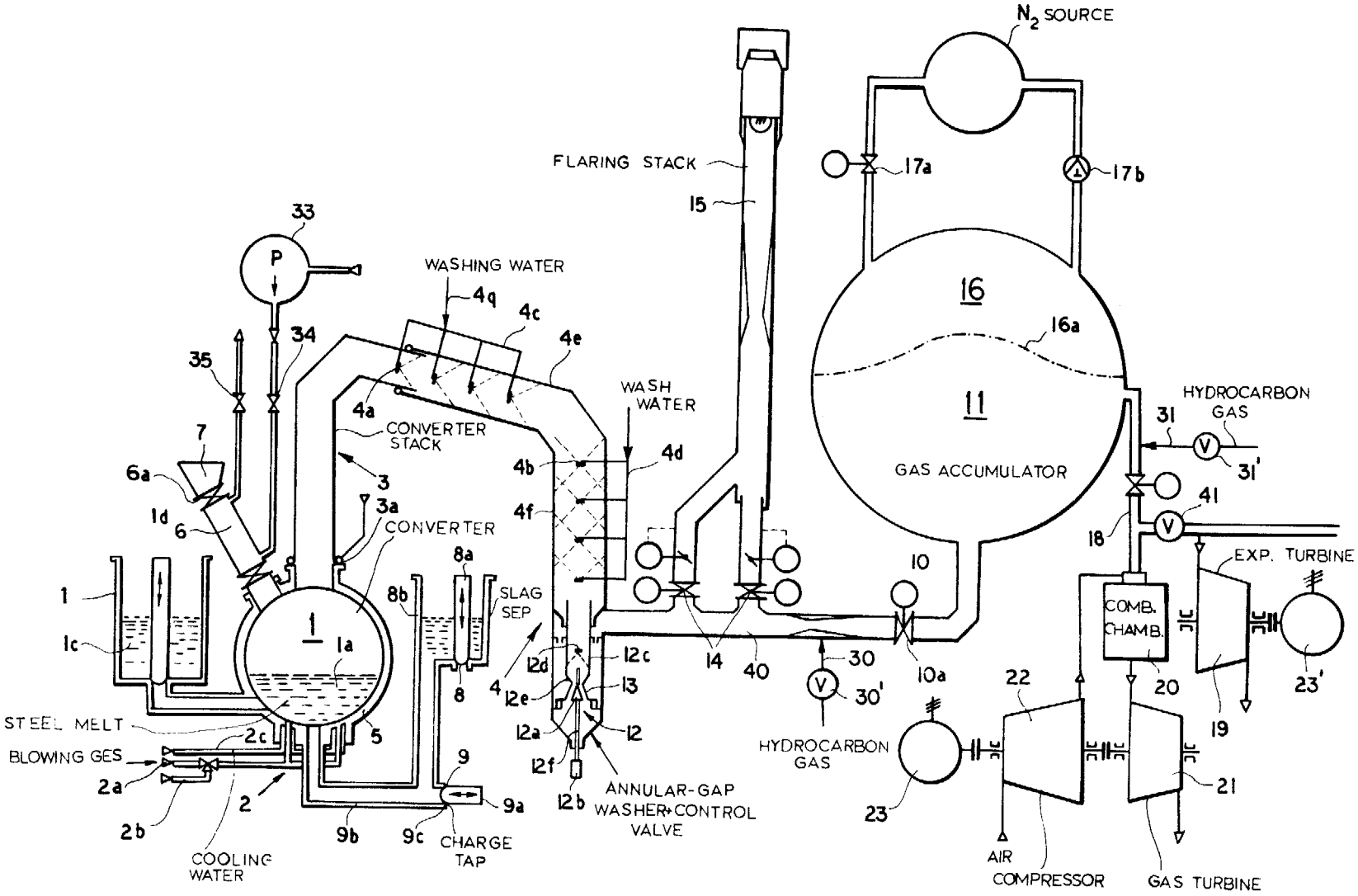
N2 SOURCE
17b
17a
16
16a
11
GAS ACCUMULATOR
HYDROCARBON GAS
31
31'
41
EXP. TURBINE
23'
19
COMB. CHAMB.
20
18
21
GAS TURBINE
22
AIR COMPRESSOR
23
10
10a
30
30'
HYDROCARBON GAS
40
14
FLARING STACK
15
WASH WATER
4d
4e
4c
4q
WASHING WATER
4b
4f
4a
CONVERTER STACK
3
3a
CONVERTER
12c
13
12
ANNULAR-GAP WASHER+CONTROL VALVE
12b
12d
12e
12a
12f
4
SLAG SEP
8a
8
8b
9
9a
CHARGE TAP
9c
9b
5
1a
1
33
P
34
35
7
6
6a
1d
1c
2c
2
COOLING WATER
2b
2a
STEEL MELT
BLOWING GES

METHOD OF RECOVERING ENERGY FROM CONVERTER EXHAUST GASES

FIELD OF THE INVENTION

The present invention relates to a method of recovering energy from converter exhaust gases and to a method of operating a steel plant such that energy can be recovered from converter exhaust gases in a steel-making plant having a converter for the refining of steel and whose exhaust gas is used in an energy-recovery process, preferably the generation of electrical energy.

BACKGROUND OF THE INVENTION

A converter in a steel-making plant for the refining of a steel melt generally is provided with means for blowing the melt within the converter with fresh gas, usually air, oxygen-enriched air or technical-purity oxygen, a converter stack by which the exhaust gases are withdrawn or removed from the converter and a washing system whereby the converter exhaust gases are scrubbed with water before being discharged.

In conventional systems of this general type, the sensible heat of the converter exhaust gas is recovered in a boiler (waste-heat boiler) which can be integrated with the converter stack. This sensible heat is thus recovered in the form of steam or hot water.

In certain cases, the converter stack can be provided with an after-burner device for recovering residual chemical energy of the converter exhaust gases. The heat generated in this fashion can be used to superheat the steam generated in the boiler. The efficiency of this type of energy recovery from converter exhaust gases is poor and leaves much to be desired.

Another disadvantage of conventional systems of the aforedescribed type for the recovery of energy from converter exhaust gases is that the converter operation is intermittent, i.e. the melt within the refining converter is only blown periodically. Thus energy can be recovered and utilized only in the cadence of the blowing. It has not been possible heretofore to recover energy continuously or independently from the blowing period of the converter period.

It has also been proposed in iron metallurgy to recover energy from exhaust gases under pressure in a turbine installation. For example, there is described in German published application (Auslegeschrift) DT-AS No. 24 39 758, a process of the latter type which is especially suitable for the recovery of energy from the exhaust gases of a high-pressure blast furnace. To our knowledge, this technique has not been applicable heretofore in the recovery of energy from converter exhaust gases.

Nor is it a simple matter to substitute a converter for a high-pressure blast furnace inasmuchas the gas output and operating conditions of the converter are vastly different from that of a blast furnace which, for all practical purposes, operates continuously.

OBJECTS OF THE INVENTION

It is the principal object of the present invention to provide a method of recovering energy from converter exhaust gases which enables the recovery of energy independently of the blowing period of the converter exhaust gas.

Still another object of the invention is to provide an improved method of utilizing the energy contact of converter exhaust gases in spite of the fact that the converter is operated by blowing only intermittently.

Still a further object of the invention is to provide a more efficient method of recovering energy from converter exhaust gases.

It is a collateral object of the invention to provide a method of operating a steel-refining plant and particularly a refining-converter installation which enables energy recovery without the disadvantages of the earlier systems described.

SUMMARY OF THE INVENTION

These objects and others which will become apparent hereinafter are attained, in accordance with the present invention, in a method of recovering energy from the exhaust gases of a steelrefining converter and/or a method of operating a steel-making converter for the recovery of energy therefrom wherein the refining process is carried out in a closed blowing converter operated at a superatmospheric pressure, i.e. a pressure within the converter from one to several atmospheres gauge, i.e. above normal or ambient pressure. The term "several atmospheres gauge above normal or ambient pressure" is intended to mean at least 2 and preferably no more than 10 atmospheres above ambient pressure.

According to an essential feature of the method aspects of the invention, the converter exhaust gases under pressure from the converter are subjected to a wet-washing or scrubbing and the scrubbed converter exhaust gas from a plurality of refining processes or blows is stored in a gas-storage vessel or accumulator under pressure and is withdrawn from the latter to operate an energy-producing gas consumer independently of the blowing period and in dependence upon the operation of the gas consumer.

The term "independent from the blowing process" is used herein to mean that the energy is available even between blowing processes from the accumulator whether or not the gas consumer may be turned on or off.

The invention is based upon our surprising discovery on the one hand that it is possible to carry out the converter refining process by blowing the melt in a closed blowing converter in which the pressure is permitted to build up to a superatmospheric level with detriment to the metallurgical requirements or operations.

Since it is possible to operate the converter without detriment in a closed and superatmospheric state, this enables the exhaust gas to be recovered at an elevated pressure and also as a highly combustible gas having a high heat value.

In other words, when the refining process is carried out with a refining gas, e.g. air, oxygen-enriched air or oxygen, it is possible to obtain a combustible converter gas having a high heat value.

Naturally, the refining gas must be introduced into the converter to blow the melt with a correspondingly higher pressure. The expression "refining gas" is used herein to refer to any converter blowing gas which has been used in the past and may be useful in the blowing of a steel melt in the converter.

The combustible converter exhaust gas contains, as its principal combustible components, carbon monoxide and water vapor. It has been found to be especially advantageous to carry out a pressure washing following an initial scrubbing of the converter exhaust gas, thereby removing toxic or corrosive components such as sulphur oxides and nitrogen oxides.

When, in accordance with a preferred embodiment of the invention, the process is carried out with a refining gas capable of transforming the converter exhaust gas to a combustible product with a high heat value, it has been found to be possible to combust at least a portion of this exhaust gas and drive a gas turbine with the combustion product. Whether or not the converter exhaust gas itself has a high heat value, it has been found to be advantageous to add a combustible with high heat value, e.g. a gaseous hydrocarbon, ahead of or downstream of the storage vessel to the converter exhaust gas. The energy recovery from the stored converter exhaust gas which has been mixed with such a fuel can be effected in part or completely in a gas turbine installation, the latter serving as the gas consumer. Alternatively or in addition, the converter exhaust gas can drive an expansion turbine and thereafter can be supplied to a boiler for waste heat recovery.

The advantages of the present invention include attainment of all of the objects stated above and, especially, the ability to operate the energy recovery units independently of the blowing period of the steel converter. As a consequence, the apparatus and control costs for the system are small as will be apparent from the specific description below. Naturally, various types of energy recovery utilizing the heat of the exhaust gas can be employed although it is preferred to drive at least one turbine with the exhaust gas in the manner described above and to use the turbine, in turn, to drive an electrical-current generator.

BRIEF DESCRIPTION OF THE DRAWING

The above and other objects, features and advantages of the present invention will become more readily apparent from the following description, reference being made to the accompanying drawing in which the sole FIGURE is a flow diagram of a steel-making plate for carrying out the invention in practice.

SPECIFIC DESCRIPTION

The drawing illustrates the best mode currently known to us for carrying out the invention in practice.

The apparatus shown in the drawing comprises a hermetically sealed converter 1 shown diagrammatically and which is provided with a bottom-blowing system represented at 2 for blowing the steel melt 1*a* in the converter with a blowing gas which can be introduced through a pipe 2*a*. A pipe 2*b* can add other desirable components to the blowing gas while a cooling-water line 2*c* provides water to jacket the blowing tubes of the blowing device generally represented at 2.

The level of the melt 1*a* in the converter can be controlled by a receptacle 1*b* connected to the converter below the surface of the melt and containing a quantity 1*c* of the molten metal. A stopper 1*d* controls transfer of the molten metal between the converter and the receptacle 1*d*.

The converter 1 is provided with a converter stack generally represented at 3 and connected through the converter by a gas pressure gate 3*a* preventing escape of gases from the converter under the superatmospheric pressure at which the latter is operated.

The charge is introduced into the converter via a hopper 7 and a charging pressure gate 6 which can have a pair of valves 6*a* and 6*b* which can be alternately opened to admit the charge from the hopper 6 to the space between the valves 6*a* and 6*b* whereupon valve 6*a* is closed and valve 6*b* is opened to permit the charge to enter the converter.

To prevent escape of gas and to maintain the pressure in the converter, a pump 33 supplies gas under pressure via the valve 34 to the gate 6, the excess gas is vented at 35.

The converter stack 3 forms a duct provided with an initial scrubbing system represented diagrammatically at 4. More particularly, the stack is divided into a downwardly extending portion 4*e* and an upright portion 4*f*. The downwardly extending portion 4*e* is provided with a group of spaced apart spray nozzles 4*a* connected by a manifold 4*c* to a source 4*g* of the wash water.

In another portion of the stack or duct, i.e. the upright portion 4*f* of the stack, is provided another array of nozzles 4*b* connected to the manifold 4*d* which is supplied with the scrubbing water.

Downstream of the scrubbing unit 4 there is provided a regulating valve 12 in the form of an annular-gap washer 13. As described in the aforementioned publication, the annular-gap washer can include a cylindrical duct 12*c* which can be provided with still another scrubbing nozzle 12*d* and through which the gas is caused to flow. The cylindrical duct 12*c* terminates at its lower end in a Ventori nozzle 12*e*, the latter being of the convergent-divergent type, the divergent section receiving a generally conical body 12*a* which can be displaced on a rod 12*f* by a servomotor 12*d* to control the pressure.

From this annular-gap washer 13, the gas is passed upwardly and thence through a duct 40. Pressure-control valves 14 permit bleeding of excess gas to a flairing stack 15 in which the exhaust gas is flared off.

An inlet 30 provided with a valve 30' can supply hydrocarbon fuel gas to the exhaust gas in the duct 40 before the exhaust gas enters the gas accumulator 11 via the connecting duct 10 and a pressure control valve 10*a*.

The gas accumulator 11 can be formed with a flexible membrane 16*a* so that the compressed gas in the compartment 16, e.g. nitrogen, will not mix with the washed and scrubbed exhaust gas from the converter.

A nitrogen source 17 connected by a pressure control valve 17*a* and a throttle valve 17*b* with the chamber 16 of the accumulator to pressurize the latter and drive the exhaust gas to the energy utilization stage.

A duct 18 leads from the gas accumulator 11 and is provided with an inlet 31 having a valve 31' for hydrocarbon fuel gas used to augment the heat value of the exhaust gas. A valve 41 controls the quantity of the exhaust gas which is bled to an expansion turbine driving the generator 23' in the manner described in the aforementioned publication.

The exhaust gas, however, has an especially high heat value and can be introduced into a combustion chamber 20 to which air is supplied by a compressor 22 to facilitate combustion of the exhaust gas in the combustion chamber.

The compressor 22 is, in turn, driven by a gas turbine 21 powered by the high velocity gases emerging from the combustion chamber. An electrical generator 23 is coupled to the shafts of the turbine 21 (so as to be driven thereby) and the compressor 22. Both generators 23 and 23' can be connected to a single network.

From the aforegoing it will be apparent that the steel-refining or making unit of the present invention includes a converter with a device 2 for the blowing of fresh gas through the melt (bottom-blowing nozzles), a converter stack 3 and a washing device 4 for the converter exhaust gases.

According to the invention, however, the converter is formed as a hermetically sealed or closed reaction vessel with a gate 6 for introducing the fresh charge from the hopper 7. The converter is also provided with a slag-removal device represented generally at 8 and a steel recovery device represented generally at 9. The slag removal device 8 comprises an upright cylinder 8*b* communicating from above with the top of the duct 9*b* leading to the charge tap 9*c* which can be selectively blocked or unblocked whenever the steel is to be recovered or tapping of the converter is desirable for some other purpose. The slag separator consists of an upright vessel 8*b* in which a plug 8*a* is displaceable.

The system also includes a converter stack 3 having an integrated wet-washing or scrubbing installation and connected to the reaction vessel 5. A connecting duct 10 connects the scrubbing units to the gas accumulator 11.

In the wet-washing or scrubbing units 4 and/or in the connecting duct between the scrubbing device 4 and the gas accumulator 11, there is provided at least one control valve 12 which enables the pressure to build up behind the valve and hence in the converter.

Naturally, the converter 1 can also be used as a continuously blown converter where the inlet 7 of the metal to be refined, the slag discharge device 8 and the steel tapping device 9 operate during converter blowing.

In the embodiment illustrated and in accordance with the best mode known to me for carrying out the invention in practice, the converter 1 is a periodically-blown converter with the control valve 12 being regulated in accordance with the blowing period.

It has already been mentioned that the scrubbing device 4 includes the annular-gap washer, e.g. of the aforementioned publication, serving simultaneously as the control valve 12. It is within the framework of the present invention to provide pressure-retaining valves 14 which enable the flaring chimney to operate efficiently, i.e. burnoff of gas.

The stack 13 is also useful when the gas supplied exceeds that which can be successively stored in the accumulator 11 in above or underground storage.

The apparatus aspects of the present invention involve the provision of the gas accumulator 11 with a volume such that it is capable of storing the exhaust gases generated over a number of exhaust gas refinings.

The accumulator 11 stores the scrubbed exhaust gas in force-transmitting relationship with a nitrogen cushion operated by the nitrogen storage source 17. The gas can be continuously withdrawn from the accumulator 11.

The gas withdrawn from the accumulator 11 is fed via line 18 to the consumer. In the consumer, at least part of the gas is burned, e.g. for recovery of energy in a boiler.

The duct 18 is connected via a valve 41 with the expansion turbine 19 discharging into the atmosphere. When the expansion turbine 19 is driven, generator 23' is engaged.

The gas from the accumulator 11 can also be introduced into a combustion chamber 20.

In the embodiment illustrated, the gas turbine 21 drives the axial compressor 22 which supplies compressed air to the combustion chamber 20. The combustion products driving the turbine 21 thus also operate a generator 23 connected thereto.

We claim:

1. A method of recovering energy from a converter exhaust gas in the refining of steel, comprising the steps of blowing melts of steel in a converter while hermetically closing same to enable the build-up of a superatmospheric pressure in said converter;

withdrawing converter exhaust gas at a superatmospheric pressure from said converter;

scrubbing the withdrawn converter exhaust gas with water in an annular-gap washer having a control member for varying the pressure differential across a scrubbing gap and thereby controlling the pressure in said converter;

storing the scrubbed converter exhaust gas for subsequent use in refining operations in a gas accumulator;

feeding a gas consumer with the exhaust gas from said accumulator independently of the blowing periods; and maintaining the converter exhaust gas under superatmospheric pressure during the blowing, withdrawing, scrubbing and storing steps without recompression.

2. The method defined in claim 1 wherein the melt in the converter is blown with a refining gas having a composition yielding a combustible converter exhaust gas with a high heat value.

3. The method defined in claim 1 wherein the melt in the converter is blown at a pressure of one to several atmospheres gauge.

4. The method defined in claim 1 wherein the converter exhaust gas before introduction into the accumulator is mixed with a fuel gas having a high heat value.

5. The method defined in claim 1 wherein the converter exhaust gas after withdrawal from said gas accumulator is mixed with a fuel gas having a high heat value.

6. The method defined in claim 1 wherein said converter exhaust gas is combusted and the gaseous combustion products are used to drive a gas turbine.

7. The method defined in claim 1 wherein the converter exhaust gas is at least partially expanded in a gas-turbine unit generating electrical energy.

8. A method of operating a steel-making plant comprising the steps of:

enclosing a melt of steel in a hermetically sealed converter;

introducing fresh charge to the melt in said converter through a pressure-retaining gate;

tapping steel from said converter while maintaining the pressure therein;

withdrawing slag from said converter while maintaining the pressure therein;

recovering converter exhaust gas at a superatmospheric pressure from said converter;

scrubbing the recovered converter exhaust gas with water in an annular-gap washer having a control member for varying the pressure differential across a scrubbing gap and thereby controlling the pressure in said converter;

storing the scrubbed converter exhaust gas for a period corresponding to at least a plurality of blows of a melt in said converter;

driving a turbine with the stored scrubbed converter gas independently of the blows of the converter; and maintaining the converter exhaust gas under superatmospheric pressure during the scrubbing and storing steps without recompression.

* * * * *